US010575088B2

(12) United States Patent
Chen

(10) Patent No.: US 10,575,088 B2
(45) Date of Patent: Feb. 25, 2020

(54) TREBLE LOUDSPEAKER WITH IMPROVED MOUNTING STRUCTURE FOR PHASE PLUG

(71) Applicant: TYMPHANY ACOUSTIC TECHNOLOGY (HUIZHOU) CO., LTD., Huizhou, Guangdong Province (CN)

(72) Inventor: Zhi Chen, Taipei (TW)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/041,108

(22) Filed: Jul. 20, 2018

(65) Prior Publication Data

US 2019/0028802 A1 Jan. 24, 2019

(30) Foreign Application Priority Data

Jul. 20, 2017 (CN) ..... 2017 1 0596962

(51) Int. Cl.

| | |
|---|---|
| ***H04R 9/06*** | (2006.01) |
| ***H04R 1/30*** | (2006.01) |
| ***H04R 31/00*** | (2006.01) |
| ***H04R 9/02*** | (2006.01) |

(52) U.S. Cl.

CPC ..... *H04R 1/30* (2013.01); *H04R 9/025* (2013.01); *H04R 9/06* (2013.01); *H04R 31/006* (2013.01); *H04R 2201/34* (2013.01); *H04R 2400/11* (2013.01); *H04R 2400/13* (2013.01)

(58) Field of Classification Search

CPC . H04R 1/30; H04R 9/06; H04R 9/025; H04R 31/006; H04R 2201/43; H04R 2400/11; H04R 2400/13

See application file for complete search history.

(56) References Cited

U.S. PATENT DOCUMENTS

2007/0165882 A1* 7/2007 Noselli ..... H04R 1/30 381/111

FOREIGN PATENT DOCUMENTS

EP 3031877 A1 * 6/2016 ..... C09K 3/1006
WO WO 2015043945 A1 * 4/2015 ..... B23K 1/00

* cited by examiner

*Primary Examiner* — Brian Ensey
(74) *Attorney, Agent, or Firm* — Muncy, Geissler, Olds & Lowe, P.C.

(57) ABSTRACT

A treble loudspeaker with an improved mounting structure for a phase plug, having a T-shaped iron, a magnet, a washer, a phase plug and a diaphragm. The magnet is located between the T-shaped iron and the washer. The T-shaped iron has a central hole. The phase plug is inserted into the central hole and fixedly connected to the T-shaped iron. A soft gasket is provided at a plane junction between the phase plug and the T-shaped iron. The diaphragm is located above the phase plug to cover the phase plug, and a sound guiding gap is provided between the diaphragm and the phase plug.

9 Claims, 7 Drawing Sheets

TREBLE LOUDSPEAKER WITH IMPROVED MOUNTING STRUCTURE FOR PHASE PLUG

BACKGROUND OF THE INVENTION

Field of the invention

The present invention relates to the field of loudspeaker manufacturing, in particular, to a treble loudspeaker with an improved mounting structure for a phase plug.

Brief Discussion of the Related Art

As one of the core components of a treble loudspeaker, a phase plug can effectively improve the frequency response characteristics, and prevent standing wave and crossover distortion, such that the off-axis frequency response characteristics and axial frequency response characteristics are smoother; that off axis frequency response peak valley phenomenon, which often appears in the treble loudspeaker, is avoided; and that sound distortion is prevented.

In the structure of a compression-type treble loudspeaker, the position relation between the diaphragm and the phase plug, and the range of the gap between them are very important. The gap between the diaphragm and the phase plug will directly affect the SPL curve and the power and other performances of the treble loudspeaker. If the gap is not controlled properly, the SPL curve will fluctuate greatly in the high frequency band, causing sound distortion.

In the existing compression-type treble loudspeaker, the gap is adjusted by adding a gasket when assembling the phase plug. However, there is a thickness tolerance in the dimension of the gasket, and the range deviation is likely to occur in the assembling process, and the requirement of the range of the gap cannot be met. In addition, such structure has high requirements on an assembly operator, which affects production efficiency.

Therefore, how to improve the design of the phase plug of the compression-type treble loudspeaker, such that the compression-type treble loudspeaker can be precisely assembled, is a technical problem that needs to be solved by those skilled in the art.

SUMMARY OF THE INVENTION

In order to solve the above-mentioned problems existing in the prior art, the present invention provides a treble loudspeaker with an improved mounting structure for a phase plug. By optimizing and improving the structure of the loudspeaker, designing a entire phase plug channel and a phase plug outlet to be in the same component, and using a high temperature resistant soft gasket between the phase plug and the T-shaped iron, a high stability of the acoustic path is ensured; the SPL curve of the treble diaphragm is smoothed and the sound quality of the speaker is ensured.

In order to achieve the above objective, the present invention provides the following technical solutions:

A treble loudspeaker with an improved mounting structure for a phase plug, comprising an iron, a magnet, a washer, a phase plug and a diaphragm, the magnet being located between the iron and the washer, wherein the iron is provided with a central hole, the central hole facilitates holding the phase plug connected to the iron, a soft gasket provided at a plane junction between the phase plug and the iron, wherein the diaphragm is located above the phase plug covering the phase plug, and forming a sound guiding gap between the diaphragm and the phase plug.

The phase plug is inserted into the interior of the central hole and fixedly connected to the T-shaped iron, wherein a lower portion of the phase plug vertically fits with the center hole; a middle portion of the phase plug fits with an inclined surface of the center hole, and a soft gasket is provided at an upper junction, i.e., the plane junction, of the phase plug and the T-shaped iron. The soft gasket can ensure the accuracy of the sound guiding gap between the diaphragm and the phase plug, and ensure the smoothness of frequency response curve (SPL curve) in the high frequency band, such that the sound of the treble diaphragm is cleaner; that the sound quality is higher, and that the sound distortion is effectively avoided.

As a further description of the technical solution of the present invention, the phase plug comprises a cap body and a supporting body, the cap body being provided with radially distributed cap body pieces, gaps being provided between the cap body pieces, the supporting body being provided with a trapezoidal cavity, and a phase plug channel being formed by the trapezoidal cavity and the gaps between the cap body pieces. By adjusting the sound phase of the loudspeaker, including extending the frequency of the treble diaphragm and adjusting the sound wave direction, the phase plug inside which the phase plug channel is formed can effectively improve the frequency response characteristics, and prevent standing wave and crossover distortion, and thus improve the treble quality.

As a further description of the technical solution of the present invention, a phase plug outlet located at the bottom of the central hole is formed by the phase plug channel at a bottom opening of the phase plug channel.

In the treble loudspeaker provided by the present invention, the phase plug channel and the phase plug outlet are designed to be in the same component, and meanwhile a high temperature resistant soft gasket is used between the phase plug and the T-shaped iron to ensure the dimensional accuracy of the sound guiding gap, such that the high stability and the integrity of acoustic path can be ensured.

As a further description of the technical solution of the present invention, the phase plug is coupled to the T-shaped iron the by a smelting equipment, such that the phase plug fits precisely with T-shaped iron and that the efficiency of the assembling operation of the mounting structure for the phase plug is effectively improved.

As a further description of the technical solution of the present invention, the tolerance of a distance A between the top of the phase plug and the adjacent side of the washer is less than 0.05 mm. A smaller tolerance of the distance A between the top of the phase plug and the adjacent side of the washer indicates a more precise assembling, such that the dimensional accuracy of the sound guiding gap between the phase plug and the diaphragm can be ensured and that distortion of sound quality can be avoided.

As a further description of the technical solution of the present invention, the soft gasket is high temperature resistant. The high temperature resistant soft gasket can effectively ensure the accuracy and stability of the encapsulation, and avoid the problem of deviation in the assembling process.

As a further description of the technical solution of the present invention, the material of the soft gasket is silica gel, rubber or plastic. In the design process of the treble loudspeaker, soft gaskets made of different materials can be chosen as needed, to ensure the reliability of the encapsulation and to prevent sound leakage.

According to the above-mentioned technical solution, the technical effects obtained by the invention are as follows:

By designing the entire phase plug channel and the phase plug outlet to be in the same component and using the high temperature resistant soft gasket between the phase plug and the T-shaped iron, the treble loudspeaker with the improved mounting structure for the phase plug provided by the present invention ensures the dimensional accuracy of the sound guiding gap, and then ensures the high stability of the acoustic path, such that the SPL curve of the treble diaphragm is smoothed; that the sound quality of the speaker, particularly the treble quality, can be improved; and that the sound distortion is avoided.

(2) The components of the treble loudspeaker with the improved mounting structure for the phase plug provided by the present invention fit precisely with each other, wherein the tolerance of the distance A between the top of the phase plug and the adjacent side of the washer is less than 0.05 mm, or even equals to zero. The accuracy of the assembling process of the treble loudspeaker is high, which effectively ensures the accuracy and stability of the encapsulation; avoids the problem of deviation in the assembling process and improves the assembly efficiency.

As a further description of the technical solution of the present invention, the diameter of the supporting body of the phase plug is adapted to the diameter of the central hole so that the phase plug is fixed to the iron by friction between the supporting body and the part of the iron forming the central hole.

As a further description of the technical solution of the present invention the iron is a T-shaped iron.

Moreover, the invention relates to a method of assembling a treble loudspeaker with an improved mounting structure for a phase plug, the treble loudspeaker comprising an iron, a magnet having a central hole, a washer, a phase plug and a diaphragm, the method comprising the steps of: providing the magnet on top of the iron, providing the washer on top of the magnet, fixing the phase plug in the central hole, thereby connecting the phase plug to the iron, providing a soft gasket at a plane junction between the phase plug and the iron, providing the diaphragm above the phase plug, thereby covering the phase plug and forming a sound guiding gap between the diaphragm and the phase plug.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION OF THE PREFERRED EMBODIMENTS

For easy understanding of the present invention, the present invention will be described more comprehensively hereinafter with reference to the accompanying drawings and specific embodiments. The preferred embodiments of the present invention are shown in the accompanying drawings. However, the invention may be embodied in many different forms and is not limited to the embodiments described herein. Rather, the purpose of providing these embodiments is to make the disclosure of the present invention to be understood more comprehensively.

Unless otherwise defined, all technical and scientific terms used herein have the same meaning as those are commonly understood by the person skilled in the art to which this invention pertains. The terms used in the specification of the present invention is for the purpose of describing specific embodiments only and is not intended to limit the invention.

Embodiment 1

Figure 1:
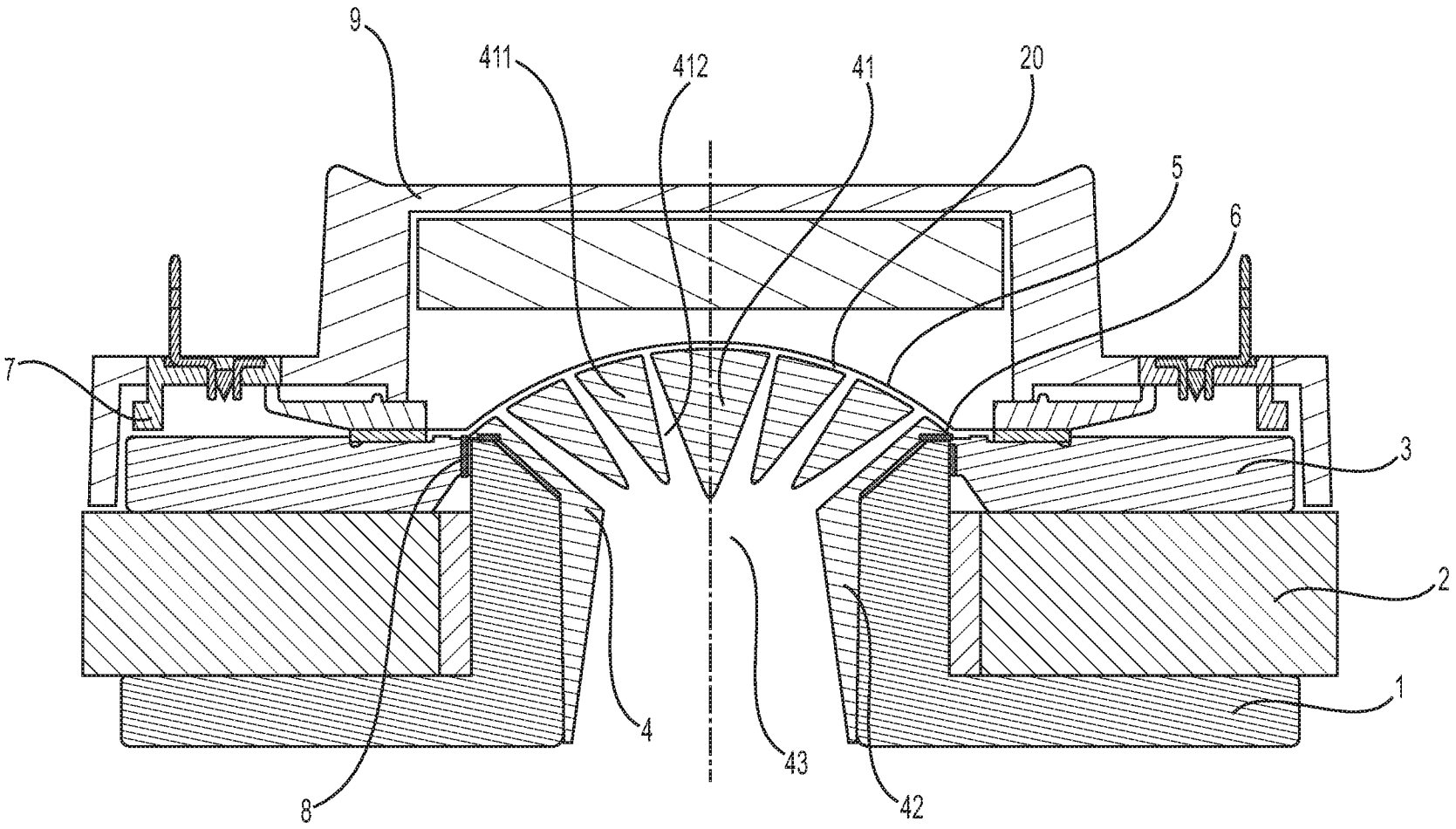
FIG. 1 is a sectional view of a treble loudspeaker with an improved mounting structure for a phase plug of the present invention.
Figure 2:
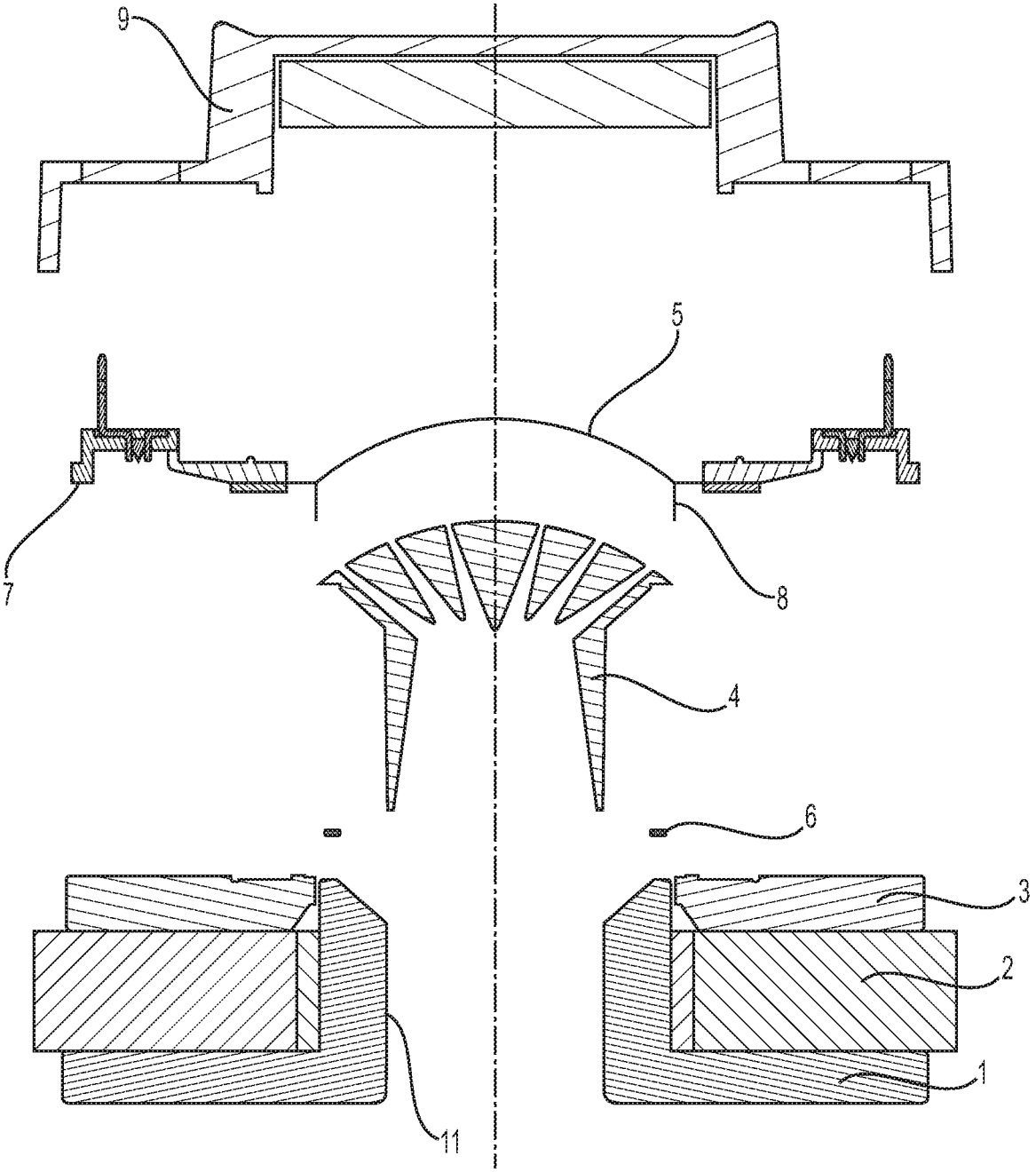
FIG. 2 is an exploded view of a cross section of the treble loudspeaker with the improved mounting structure for the phase plug of the present invention.
Figure 3:
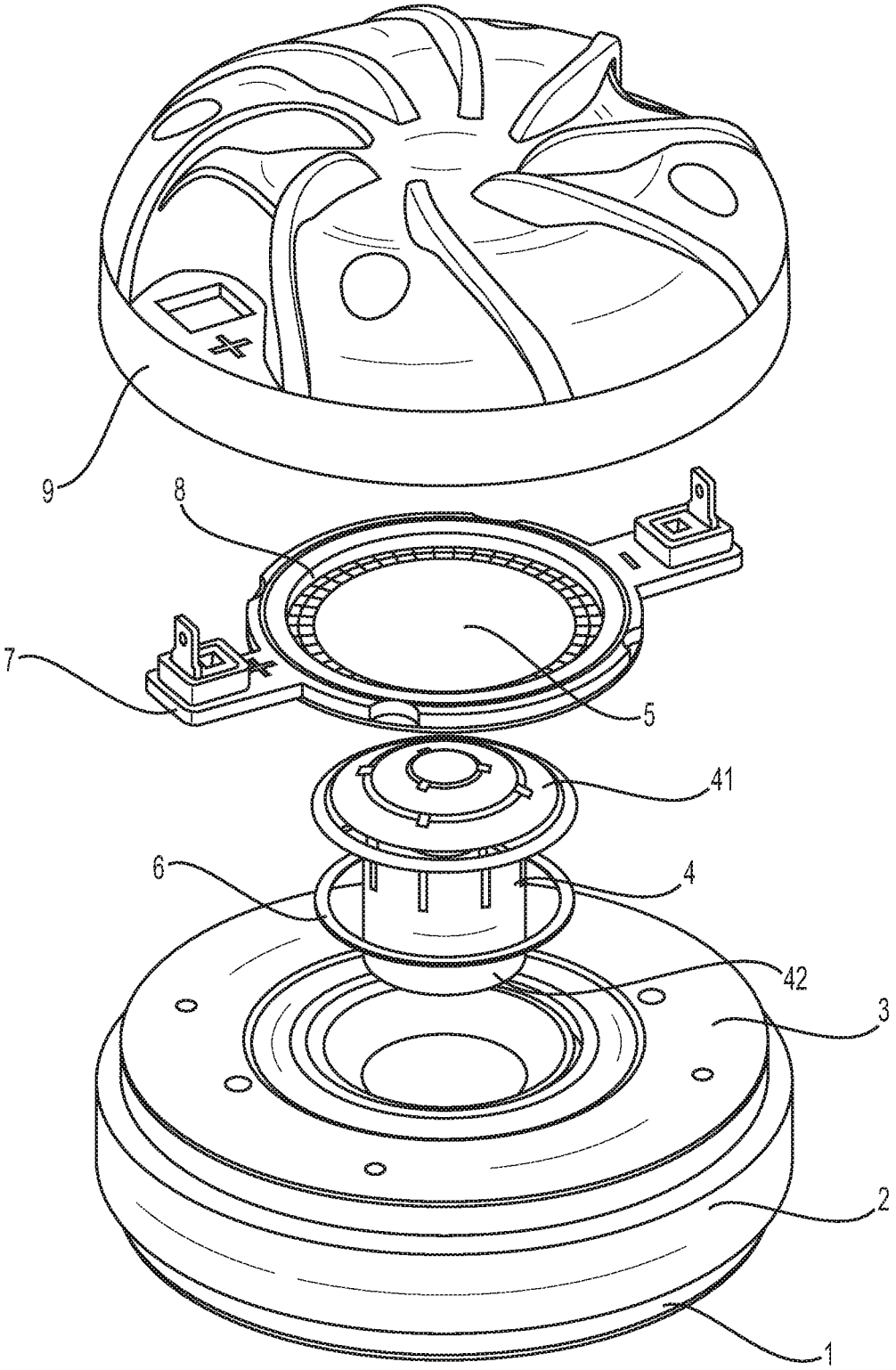
FIG. 3 is an exploded view of the treble loudspeaker with the improved mounting structure for the phase plug of the present invention.

FIGS. 1- 3 shows a sectional view, an exploded view of a cross section and an exploded view of a treble loudspeaker with an improved mounting structure for a phase plug of the present invention, respectively. Referring to FIGS. 1-3, A treble loudspeaker with an improved mounting structure for a phase plug, comprise a T-shaped iron 1, a magnet 2, a washer 3, a phase plug 4, a diaphragm 5, a soft gasket 6, a bracket 7, a voice coil 8 and a top cover 9. Wherein the voice coil 8 is located on the outer side of the T-shaped iron 1, the diaphragm 5 is fixedly connected to the bracket 7, and the bracket 7 and the washer 3 are accommodated in the interior of the top cover 9; and the magnet 2 is located between the T-shaped iron 1 and the washer 3. In the structure of T-shaped iron 1, the T-shaped iron 1 is provided with a central hole 11, the phase plug 4 is inserted into the central hole 11 and fixedly connected to the T-shaped iron 1, a soft gasket 6 is provided at a plane junction between the phase plug 4 and the T-shaped iron 1, the diaphragm 5 is located above the phase plug 4 to cover the phase plug 4, and a sound guiding gap 20 being provided between the diaphragm 5 and the phase plug 4.

Referring further to FIG. 1, the phase plug 4 is inserted into the interior of the central hole 11 and fixedly connected to the T-shaped iron 1. With respect to the connection of them, a lower portion of the phase plug 4 vertically fits with the center hole 11; a middle portion of the phase plug 4 fits with an inclined surface of the center hole 11; and at an upper junction, i.e., the plane junction, of the phase plug 4 and the T-shaped iron 1, a soft gasket 6 is provided. Referring further to FIG. 3, the soft gasket 6 is an annular one. Further, the soft gasket 6 is a high temperature resistant, and the material of the soft gasket 6 is preferably silica gel, rubber or plastic. In the design process of the treble loudspeaker, soft gaskets 6 made of different materials can be chosen as needed, to ensure the reliability of the encapsulation and to prevent sound leakage.

In the structure of the compression-type treble loudspeaker, the position relation between the diaphragm and the phase plug, and the range of the gap between them is very important. In particular, the gap between the diaphragm 5 and the phase plug 4 will directly affect the SPL (SPL; Sound Pressure Level) curve and the power and other performances of the treble loudspeaker. So, if the gap 20 is not controlled properly, the frequency response curve (SPL curve) will fluctuate greatly in the high frequency band, causing sound distortion.

By providing, with a high temperature resistant, a soft gasket 6 at the plane junction of the phase plug 4 and the T-shaped iron 1, the treble loudspeaker of this embodiment can ensure the accuracy of the sound guiding gap 20 between the diaphragm 5 and the phase plug 4 and ensure the smoothness of frequency response curve (SPL curve) in the high frequency band, such that the sound of the treble diaphragm is cleaner, and that the sound quality is higher.

Based on the above, in the present embodiment, the range of the sound guiding gap 20 between the diaphragm 5 and the phase plug 4 is well designed and controlled to be from 0.4 mm to 1.2 mm, to effectively avoid a great fluctuation of the SPL curve in the high frequency band.

Figure 4:
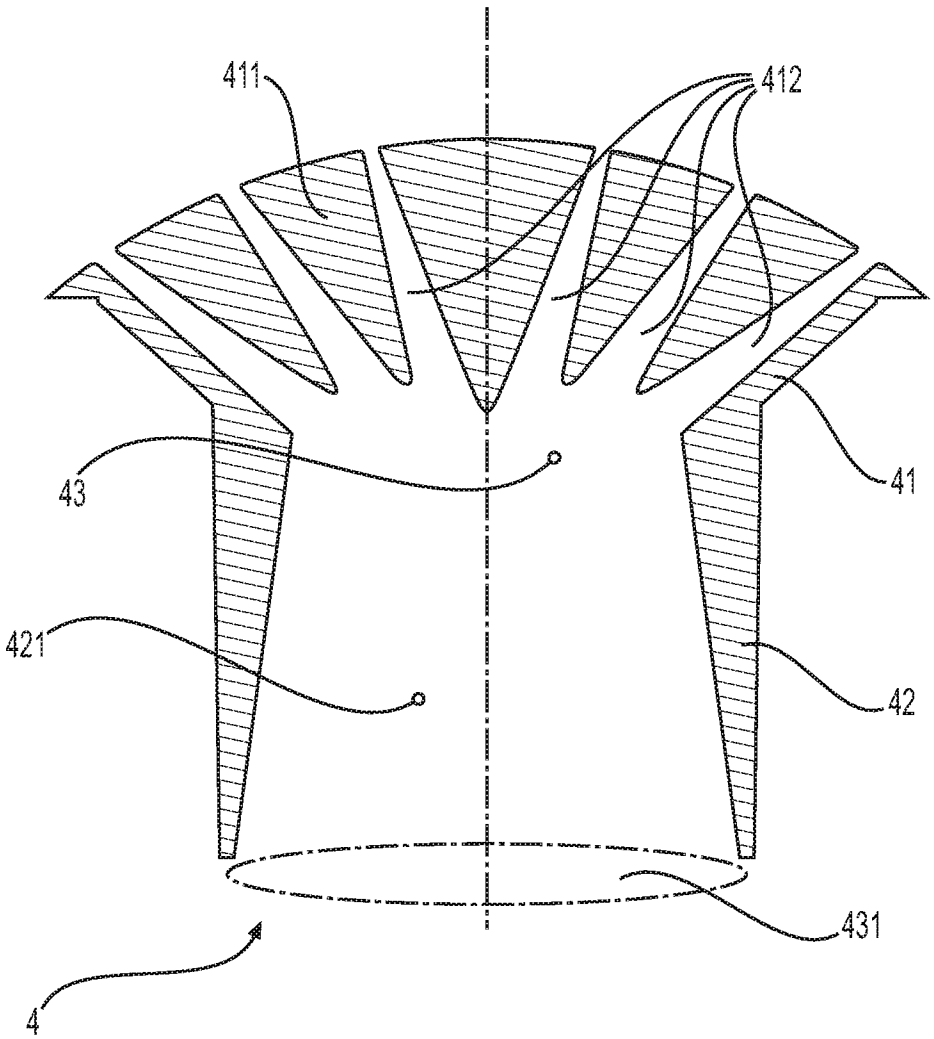
FIG. 4 is a structural schematic view of the phase plug of the present invention.

FIG. 4 is a structural schematic view of a phase plug 4 of the present embodiment. As shown in FIG. 4, and also referring to FIG. 1 at the same time, the phase plug 4 comprises a cap body 41 and a supporting body 42, the cap body 41 being provided with radially distributed cap body pieces 411, gaps 412 being provided between the cap body pieces 411, the supporting body 42 being provided with a trapezoidal cavity 421, and a phase plug channel 43 being formed by the trapezoidal cavity 421 and the gaps 412 between the cap body pieces 411.

In the treble loudspeaker, by adjusting the sound phase of the loudspeaker, including extending the frequency of the treble diaphragm and adjusting the sound wave direction, the phase plug 4 inside which the phase plug channel 43 is formed can effectively improve the frequency response characteristics, and prevent standing wave and crossover distortion.

It should be noted that a phase plug outlet 431 located at the bottom of the central hole 11 is formed by the phase plug channel 43 at a bottom opening of the phase plug channel 43. In the present embodiment, the phase plug channel 43 and the phase plug outlet 431 are designed to be in the same component, and meanwhile the high temperature resistant soft gasket 6 is used between the phase plug 4 and the T-shaped iron 1 to ensure the dimensional accuracy of the sound guiding gap 20, such that a high stability and an integrity of the loudspeaker can be ensured.

Figure 5:
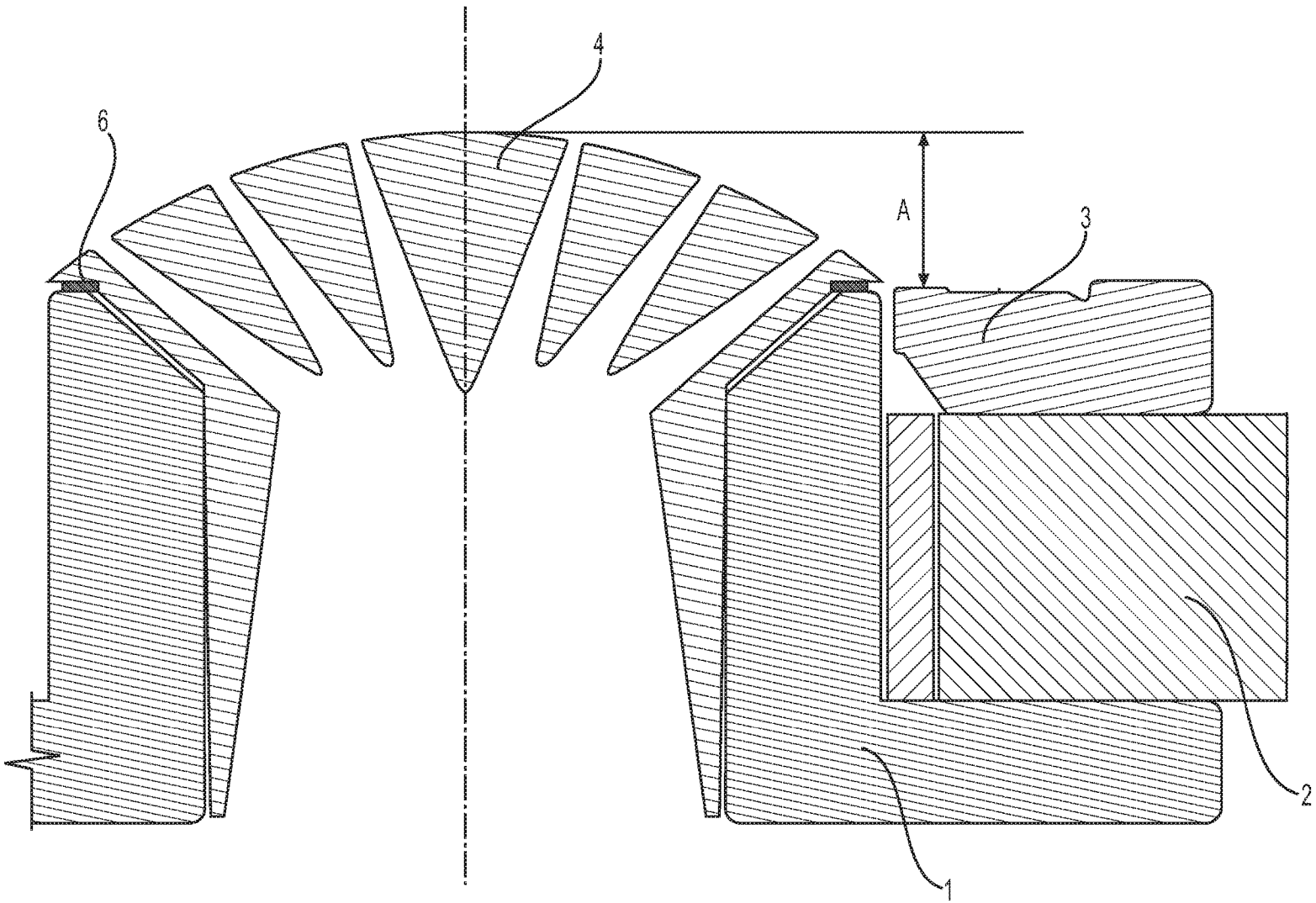
FIG. 5 is a schematic view of a distance A between the top of the phase plug and the adjacent side of the washer of the present invention.

FIG. 5 is a schematic view of the distance A between the top of the phase plug 4 and the adjacent side of the washer 3 of the present embodiment. In the present embodiment, by optimizing and improving the structure of the phase plug 4 of the compression-type treble loudspeaker, the tolerance of a distance A between the top of the phase plug 4 and the adjacent side of the washer 3 is controlled to be within 0.1 mm and zero, preferably less than 0.05 mm, or even to be equaled to zero, in the assembling process. And thus, the treble loudspeaker can be precisely assembled; the dimensional accuracy of sound guiding gap 20 between the diaphragm 5 and the phase plug 4 is ensured, and the sound distortion is avoided.

Figure 6:
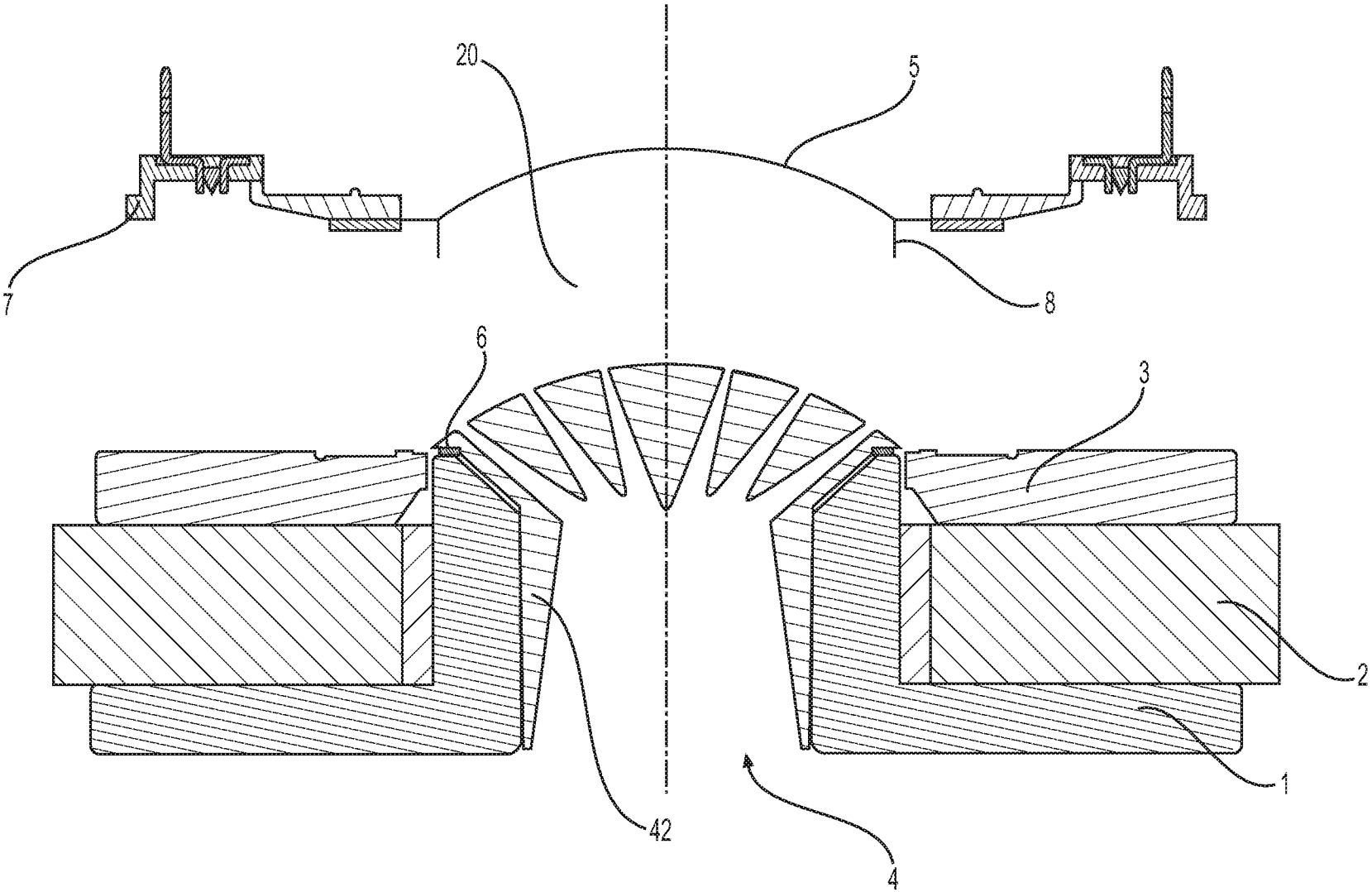
FIG. 6 is a schematic view showing how the phase plug of the present invention is coupled to and mounted in a T-shaped iron.

FIG. 6 is a schematic view showing how a phase plug 4 of the present embodiment is coupled to and mounted in the T-shaped iron 1. As shown in FIG. 6, in the assembling process, firstly, the diaphragm 5 is assembled with the bracket 7, and optimum concentricity of the outer diameter of the bracket 7 in relation to the voice coil 8 is maintained; secondly, the T-shaped iron 1, the magnet 2 and the washer 3 are assembled into a magnetic circuit system; after the assembling of the magnetic circuit system is finished, the phase plug 4 is coupled into the central hole 11 of the T-shaped iron 1 preferably by a smelting equipment, such that the phase plug 4 fits precisely with the T-shaped iron 1; finally, the diaphragm 5 is coupled to the washer 3, and the outer diameter of the bracket 7 can precisely fit with the inner diameter of a step of the washer 3. The entire assembling process is accurate and reliable, and the efficiency of the assembling operation is high.

Figure 7:
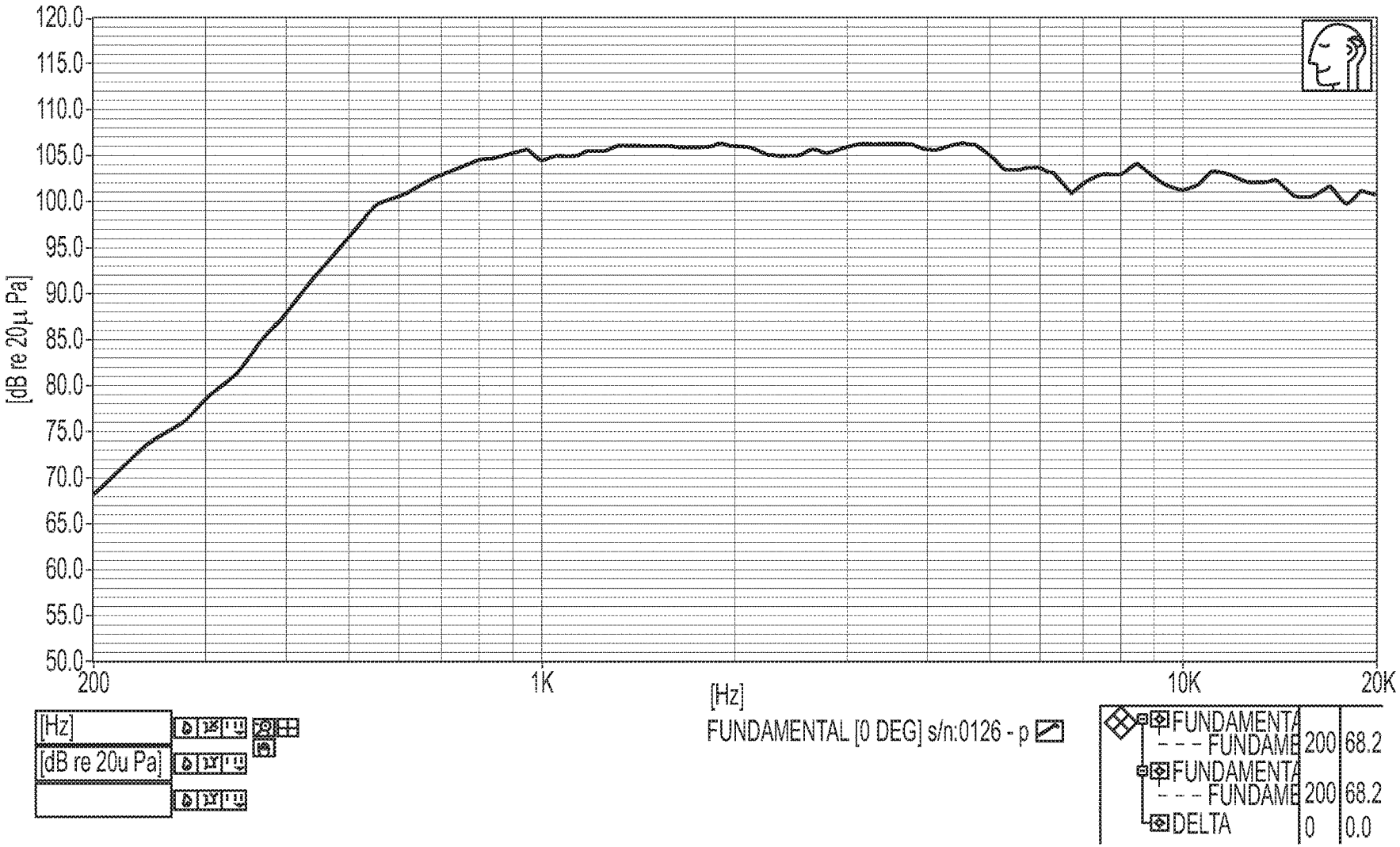
FIG. 7 is a schematic view of a frequency response curve of the treble loudspeaker with the improved mounting structure for the phase plug of the present invention.

FIG. 7 is a schematic view of a frequency response curve of the treble loudspeaker with the improved mounting structure for the phase plug of the present invention. By designing the entire phase plug channel 43 to be together with the phase plug outlet 431 and using the high temperature resistant soft gasket 6 between the phase plug 4 and the T-shaped iron 1, the treble loudspeaker with the improved mounting structure for the phase plug 4 of the present embodiment ensures the dimensional accuracy of the sound guiding gap 20, and then ensure the high stability of the acoustic path. As shown in FIG. 7, the SPL curve of the treble loudspeaker in the high frequency band is maintained smooth, such that the sound quality, particularly the treble quality, can be improved; and that the sound distortion is avoided.

The above-mentioned content, which is described more specifically and detailed, is merely an illustration and explanation of the structure of the invention, but should not be construed as a limitation to the scope of the invention. It should be noted that various modifications and improvements can be made by the person skilled in the art without departing from the spirit of the invention, and that these obvious alternatives belong the scope of the present invention.

The invention claimed is:

1. A treble loudspeaker with an improved mounting structure for a phase plug, comprising:

an iron;

a washer;

a magnet located between the iron and the washer;

a phase plug; and a diaphragm, wherein the iron comprises:

a central hole, the central hole facilitates holding the phase plug connected to the iron; and a soft gasket provided at a plane junction between the phase plug and the iron, wherein the diaphragm is located above the phase plug covering the phase plug, and forming a sound guiding gap between the diaphragm and the phase plug, and wherein a tolerance of a distance A between a top of the phase plug and an adjacent side of the washer is less than 0.05 mm.

2. The treble loudspeaker with the improved mounting structure for the phase plug according to claim 1, wherein the phase plug comprises a cap body and a supporting body, the cap body being provided with radially distributed cap body pieces, gaps being provided between the cap body pieces, the supporting body being provided with a trapezoidal cavity, and a phase plug channel being formed by the trapezoidal cavity and the gaps between the cap body pieces.

3. The treble loudspeaker with the improved mounting structure for the phase plug according to claim 2, wherein a phase plug outlet located at the bottom of the central hole is formed by the phase plug channel at a bottom opening of the phase plug channel.

4. The treble loudspeaker with the improved mounting structure for the phase plug according to claim 1, wherein the phase plug is coupled to the iron the by a smelting equipment.

5. The treble loudspeaker with the improved mounting structure for the phase plug according to claim 1, wherein the soft gasket is high temperature resistant.

6. The treble loudspeaker with the improved mounting structure for the phase plug according to claim 1, wherein the material of the soft gasket is silica gel, rubber or plastic.

7. The treble loudspeaker with the improved mounting structure for the phase plug according to claim 2, wherein the diameter of the supporting body of the phase plug is adapted to the diameter of the central hole so that the phase plug is fixed to the iron by friction between the supporting body and the part of the iron forming the central hole.

8. The treble loudspeaker with the improved mounting structure for the phase plug according to claim 1, wherein the iron is a T-shaped iron.

9. A method of assembling a treble loudspeaker with an improved mounting structure for a phase plug, the treble loudspeaker comprising an iron, a magnet having a central hole, a washer, a phase plug and a diaphragm, the method comprising:

providing the magnet on top of the iron;

providing the washer on top of the magnet;

fixing the phase plug in the central hole, thereby connecting the phase plug to the iron, providing a soft gasket at a plane junction between the phase plug and the iron, and providing the diaphragm above the phase plug, thereby covering the phase plug and forming a sound guiding gap between the diaphragm and the phase plug, and wherein a tolerance of a distance A between a top of the phase plug and an adjacent side of the washer is less than 0.05 mm.

* * * * *